US009850689B2

(12) United States Patent
Salamey et al.

(10) Patent No.: US 9,850,689 B2
(45) Date of Patent: Dec. 26, 2017

(54) VEHICLE DOOR CABLE ABUTMENT

(75) Inventors: Kristyna Salamey, Dearborn Heights, MI (US); Richard K. Mette, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1588 days.

(21) Appl. No.: 13/096,022

(22) Filed: Apr. 28, 2011

(65) Prior Publication Data

US 2012/0272776 A1 Nov. 1, 2012

(51) Int. Cl.

| | |
|---|---|
| ***E05B 79/20*** | (2014.01) |
| ***E05B 79/22*** | (2014.01) |
| *E05B 85/10* | (2014.01) |

(52) U.S. Cl.

CPC ..... *E05B 79/22* (2013.01); *E05B 79/20* (2013.01); *E05B 85/10* (2013.01); *Y10T 74/20396* (2015.01)

(58) Field of Classification Search

USPC ..... 74/502.4, 502.6, 500.5, 501.5 R

See application file for complete search history.

(56) References Cited

U.S. PATENT DOCUMENTS

| | | | | |
|---|---|---|---|---|
| 4,635,498 | A * | 1/1987 | Zimmermann et al. | 74/502.4 |
| 4,785,686 | A * | 11/1988 | Thomas | 74/502.4 |
| 5,590,567 | A * | 1/1997 | Marrs et al. | 74/502.4 |
| 5,816,109 | A * | 10/1998 | Dege | 74/502.4 |
| 6,131,482 | A * | 10/2000 | Klippert et al. | 74/502.6 |
| 6,178,845 | B1 * | 1/2001 | Gutschner | 74/502.4 |
| 2006/0048598 | A1 * | 3/2006 | Roussel et al. | 74/502.6 |

* cited by examiner

*Primary Examiner* — William Kelleher
*Assistant Examiner* — Gregory Prather
(74) *Attorney, Agent, or Firm* — Quinn IP Law

(57) ABSTRACT

A cable fitting includes a hollow cylinder sized to receive a portion of a sheath therein; and a lever including a blade supported on the cylinder; a pivot about which the blade pivots; an engagement member secured to the blade and spaced from the pivot in a first direction; and a tab secured to the blade and including a surface spaced from the pivot in a second direction opposite the first direction and on which force can be applied to elastically pivot the engagement member away from an engaged position.

1 Claim, 3 Drawing Sheets

VEHICLE DOOR CABLE ABUTMENT

BACKGROUND OF INVENTION

The present invention relates generally to a mechanism for actuating a vehicle door handle, and particularly to a cable fitting or abutment for engaging and disengaging an inside door handle located outboard of a door trim pad.

Typically a vehicle assembler requires training to learn how to attach a cable to a door handle located on the door and outboard of a door trim pad. When the door is being serviced, technicians may be puzzled regarding the proper way to remove the door abutment of the actuating cable from its attachment to the door handle. Occasionally, the cable is pulled in an attempt to disconnect the cable assembly, or the technician may use a screw driver incorrectly to remove the abutment connection. In either case, the abutment is sometimes broken.

Currently, door handle actuation employs tree-type abutments that attach on the inner surface of the handle. Such abutments require a tool for removal.

SUMMARY OF INVENTION

A cable fitting includes a hollow cylinder sized to receive a portion of a sheath therein; and a lever including a blade supported on the cylinder; a pivot about which the blade pivots; an engagement member secured to the blade and spaced from the pivot in a first direction; and a tab secured to the blade and including a surface spaced from the pivot in a second direction opposite the first direction and on which force can be applied to elastically pivot the engagement member away from an engaged position.

The elastic operation of the lever occurs due to elastic flexure without need for a spring.

The abutment design allows technicians, operators and service mechanics to connect and disconnect the cable to the inside handle without the use of a tool. A lever on the abutment can be alternately depressed manually without use of a tool to disengage the cable assembly and released manually without a tool to reengage the cable assembly such that pivoting motion of the lever is conducted within the ergonomic constraints of a 45 Newton thumb load.

The abutment design is intuitive for connection and disconnection, and is less likely to break due to incorrect tool usage or failure to apply a correct connection and disconnection technique. The lever may enable installation and removal of the cable assembly such that when the lever is depressed, the front end of the abutment deflects upward, thereby allowing the abutment to easily enter or exit a connection to the inside door handle.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DETAILED DESCRIPTION

Figure 1:
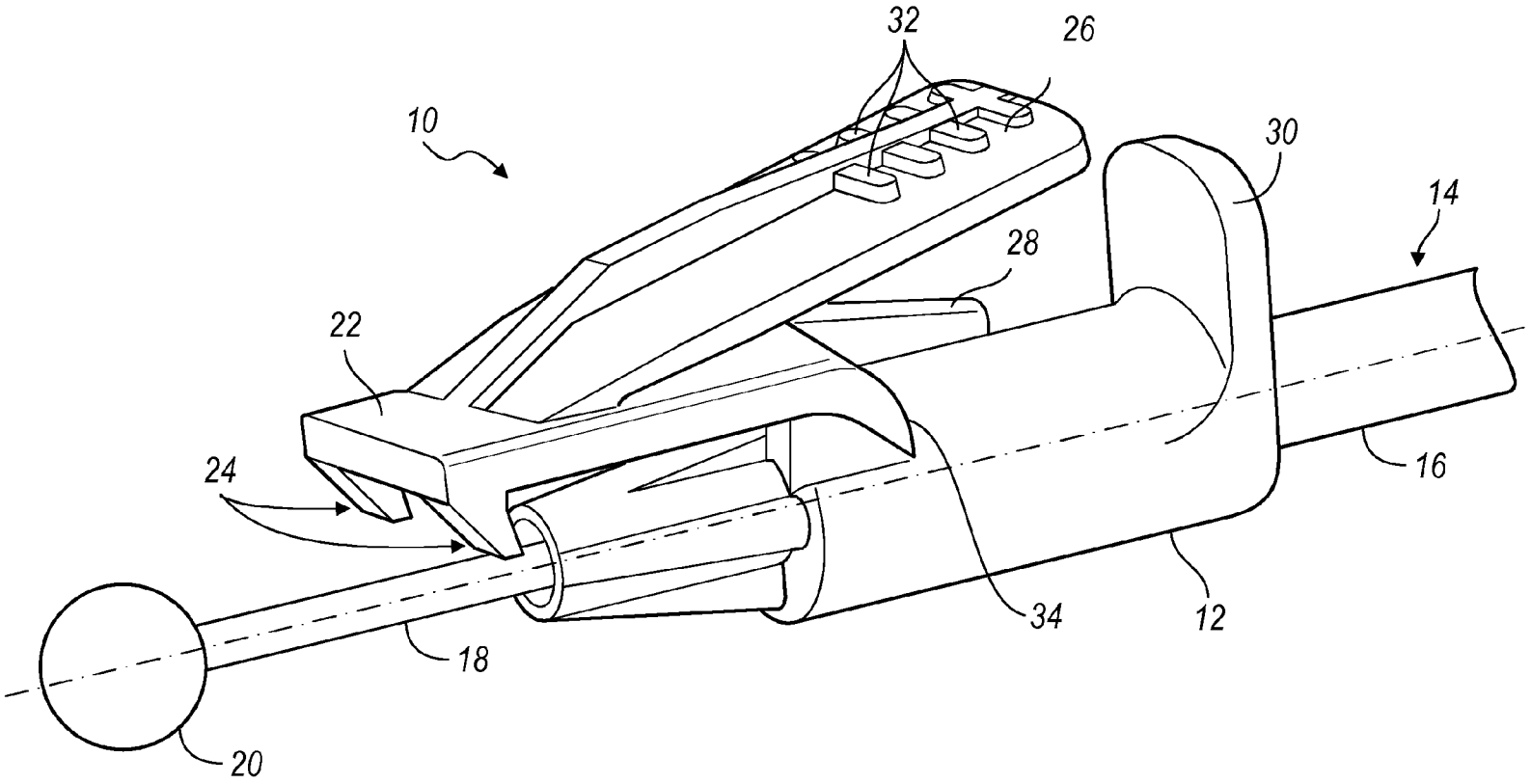
FIG. 1 is a front perspective view of a cable end fitting for a vehicle door.
Figure 2:
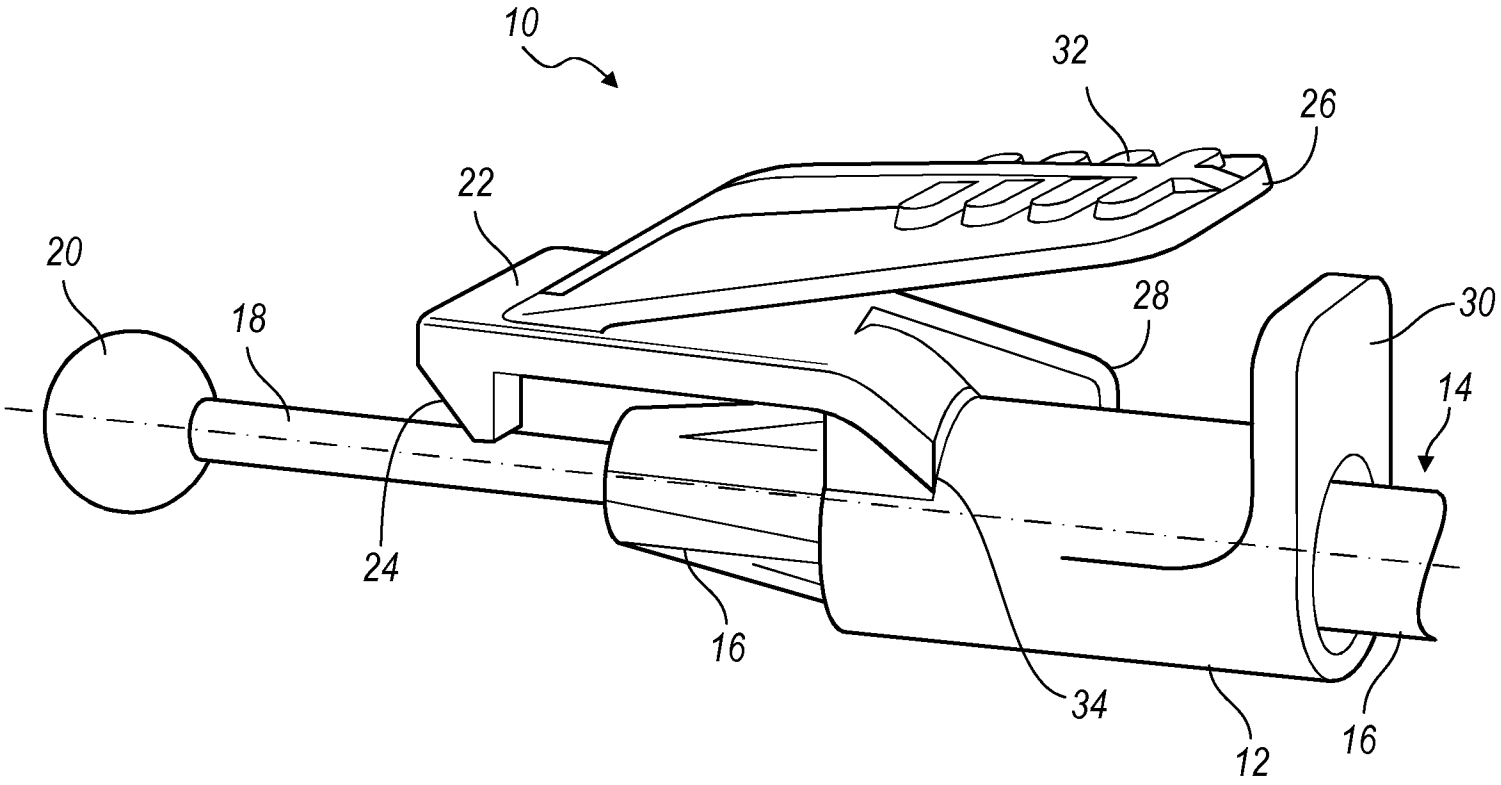
FIG. 2 is rear perspective view of the cable end fitting.

Referring now to FIGS. 1 and 2, the cable end fitting 10 includes a sleeve member 12, which is preferably in the form of a hollow cylinder sized to receive a portion of a cable assembly 14 therein. The cable assembly 14 includes a hollow cylindrical sheath 16 and a cable or rod 18 that extends along the length of the sheath. Sleeve member 12 allows the rod 18 to extend through the sheath 16 and to protrude outward from an end of the cable end fitting's sleeve member 12. A spherical ball 20 is secured to an end of rod 18. The rod and ball operate as an actuator due to their ability to be displaced relative to and along the length of the sheath 16 and fitting 10.

The cable end fitting 10, which is preferably formed of molded plastic material, includes a blade portion 22, supported on the outer surface of sleeve member 12; teeth 24 extending from a lower surface of the blade 22; a service tab 26, supported on blade 22 for actuating the teeth 24; a service tab stop 28, located at an inboard lateral side of the sleeve member 12; and a projection 30 extending from an end of the sleeve member opposite the location of the teeth 24. When tab 26 is depressed, contact between the tab 26 and the tab stop 28 limits the range of pivotal displacement of the tab 26.

Projection 30 aids in manually gripping the cable fitting 10 during installation and removal, and helps prevent entangling the fitting 10 with other cables in the vehicle door assembly. Corrugations 32 on the outer service tab 26 indicate intuitively a place where an operator can apply pressure to depress the service tab 26.

Blade 22 is connected to the outer surface of sleeve member 12 at a relatively narrow pivot surface 34, which extends laterally across the outer surface of the cylinder. The location of the corrugations 32, where force is applied to the service tab 26, is spaced along sleeve member 12 in a first direction from the pivot 34. Teeth 24 are spaced along sleeve member 12 in a second direction opposite the first direction from the pivot 34. This arrangement forms a lever that actuates teeth 24 into and out of engagement.

When the service tab 26 is depressed, blade 22 and teeth 24 pivot upward due to elastic flexure that occurs at the pivot 34. When tab 26 is released, blade 22 and teeth 24 pivot downward due to elastic flexure that occurs at pivot 34.

Figure 3:
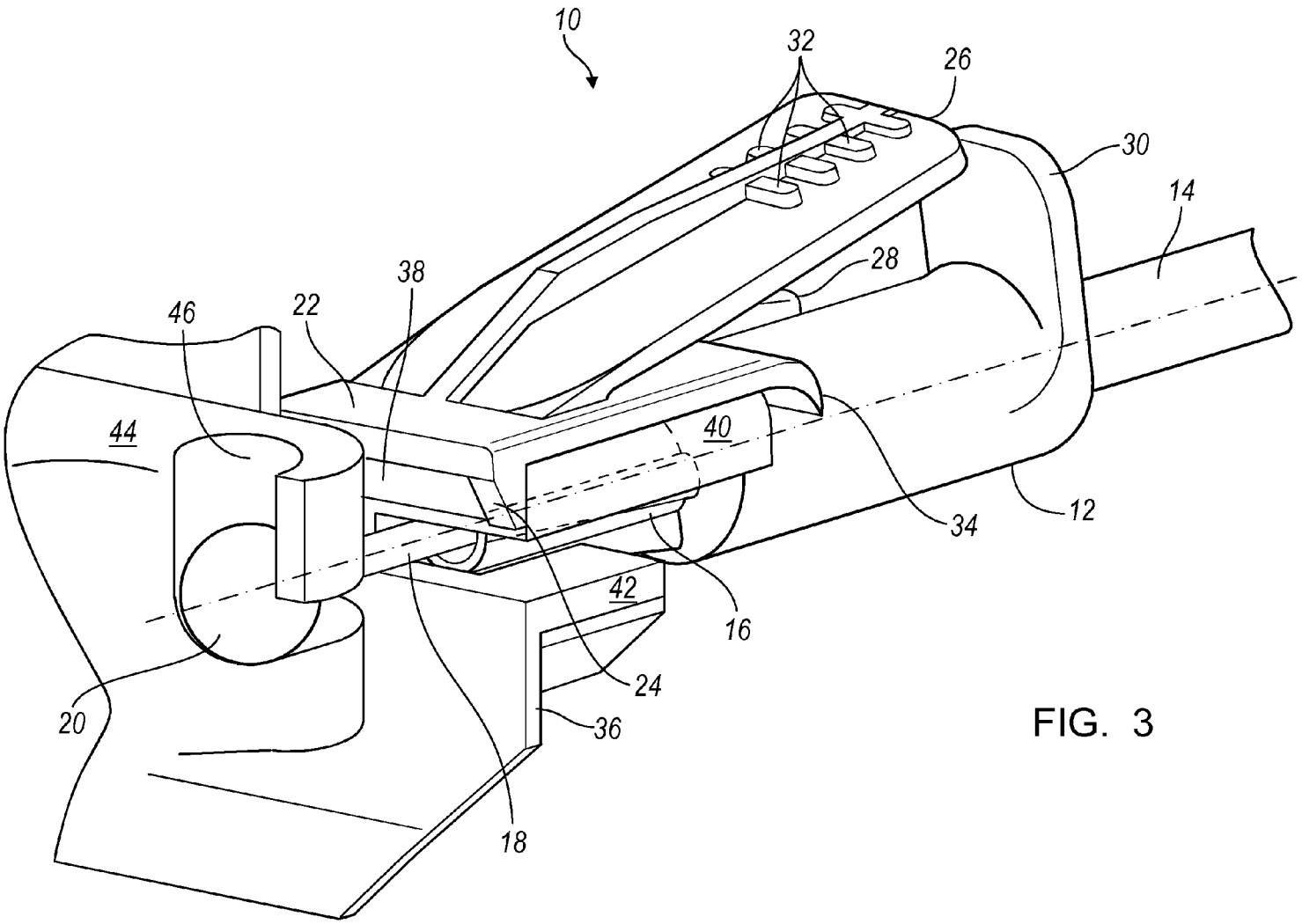
FIG. 3 is perspective view showing the cable end fitting secured to a door bracket.

FIG. 3 shows the cable end fitting 10 secured to a bracket 36 connected to an inside handle 44 of a vehicle door. In the secured state, teeth 24 engage a surface 38 of bracket 36, thereby securing fitting 10 and cable assembly 14 to the bracket. Rod 18 is installed through a space between upper and lower flanges 40, 42 of bracket 36. Ball 20 engages a cylindrical passage 46 formed in the front door handle 44, thereby permitting the handle to pivot about the axis of the ball.

The cable end fitting 10 and cable 14 are secured to bracket 36 without need for any tool by securing ball 20 to the cylindrical passage 46 and passing the teeth 24 across the surface of the upper flange 40, preferably while the service tab 26 is depressed manually, then releasing the tab 26, and allowing teeth 24 to pivot downward into engagement with surface 38 of the upper flange 40 of bracket 36.

The cable end fitting 10 and cable 14 are released from engagement with bracket 36 without the need for any tool by manually depressing tab 26, thereby causing teeth 24 to pivot upward and to disengage surface 38 of the upper flange

40 of bracket 36. Then the ball 20 is removed from the passage 46, and rod 18 is displaced laterally in the space between the upper and lower flanges 40, 42 of bracket 36.

While certain embodiments of the present invention have been described in detail, those familiar with the art to which this invention relates will recognize various alternative designs and embodiments for practicing the invention as defined by the following claims.

What is claimed is:

1. A cable fitting, comprising:

a hollow cylinder sized to receive a cable assembly extending therethrough, the cable assembly including a cable slideably received in a sheath, the hollow cylinder having a first end configured to engage a retention member on an end of the cable to prevent the cable from sliding out of the hollow cylinder and a second end configured to receive a portion of the sheath herein; and a lever including;

a blade supported on the cylinder adjacent to the first end;

a pivot about which the blade pivots, the pivot extending radially from the cylinder closer to the second end than the blade;

an engagement member secured to the blade, extending radially inward toward the cable, and spaced from the pivot in a first direction, the first direction being oriented away from the second end;

a tab secured to the blade between the pivot and the engagement member and extending to a surface spaced from the pivot in a second direction opposite the first direction, the surface being closer to the second end than the pivot, the surface being configured such that a force can be applied to pivot the engagement member away from an engaged position; and a tab stop extending radially outward from the cylinder between the pivot and the second end and radially closer to the cable assembly than the surface of the tab, for limiting displacement of the tab about the pivot when the tab is depressed.

* * * * *